US005660195A

United States Patent [19]

Taylor, Jr. et al.

[11] Patent Number: 5,660,195

[45] Date of Patent: Aug. 26, 1997

[54] DISHWASHER VENT SYSTEM

[75] Inventors: Marion Lee Taylor, Jr.; Lars Rosengren, both of Kinston, N.C.

[73] Assignee: White Consolidated Industries, Inc., Cleveland, Ohio

[21] Appl. No.: 611,485

[22] Filed: Mar. 5, 1996

[51] Int. Cl.[6] ..... A47L 15/48

[52] U.S. Cl. ..... 134/58 D; 134/95.2; 134/183; 134/200; 34/235; 312/213

[58] Field of Search ..... 134/56 D, 57 D, 134/57 DL, 58 D, 58 DL, 95.2, 183, 200; 34/235; 312/213, 214, 400

[56] References Cited

U.S. PATENT DOCUMENTS

| | | | |
|---|---|---|---|
| 3,064,662 | 11/1962 | Given et al. | 134/95.2 |
| 3,092,122 | 6/1963 | Guth | 134/95.2 X |
| 3,130,737 | 4/1964 | Jellies | 134/95.2 X |
| 3,170,743 | 2/1965 | Martiniak | 312/213 |
| 3,193,340 | 7/1965 | Braden | 312/213 |
| 3,294,461 | 12/1966 | Barnard et al. | 312/213 |
| 3,398,756 | 8/1968 | Kauffman | 134/18 X |
| 3,538,616 | 11/1970 | Malling | 34/235 X |
| 3,588,213 | 6/1971 | Braga et al. | 312/214 |
| 3,876,469 | 4/1975 | Schimke | 134/95.2 |
| 3,883,201 | 5/1975 | Busoni | 134/95.2 X |
| 3,908,681 | 9/1975 | Schimke et al. | 134/95.2 |
| 4,179,821 | 12/1979 | Herbst et al. | 34/235 |
| 4,247,158 | 1/1981 | Quayle | 134/200 X |
| 4,657,036 | 4/1987 | Yake | 134/95.2 |
| 4,765,697 | 8/1988 | Gardell et al. | 312/213 X |
| 4,940,298 | 7/1990 | Jackson et al. | 312/228 |
| 5,076,306 | 12/1991 | Suzuki et al. | 134/95.2 |
| 5,287,868 | 2/1994 | Tuller et al. | 134/95.2 |
| 5,331,984 | 7/1994 | Isagawa | 134/57 D |
| 5,355,900 | 10/1994 | Sakata | 134/95.2 |

FOREIGN PATENT DOCUMENTS

| | | | |
|---|---|---|---|
| 3609788 | 9/1987 | Germany | 134/57 D |

*Primary Examiner*—Philip R. Coe

*Attorney, Agent, or Firm*—Pearne, Gordon, McCoy & Granger LLP

[57] ABSTRACT

A passive or dynamic venting system for a frontloading dishwasher is located within the dishwasher door and includes a plate-shaped valve which closes off a valve port in the inner liner or face of the door; the valve is moved by a linear actuator along a path of closing and opening that is perpendicular to the plane of the door. In the dynamic system, a cross-flow type blower is also located within the door.

20 Claims, 2 Drawing Sheets

Fig.2
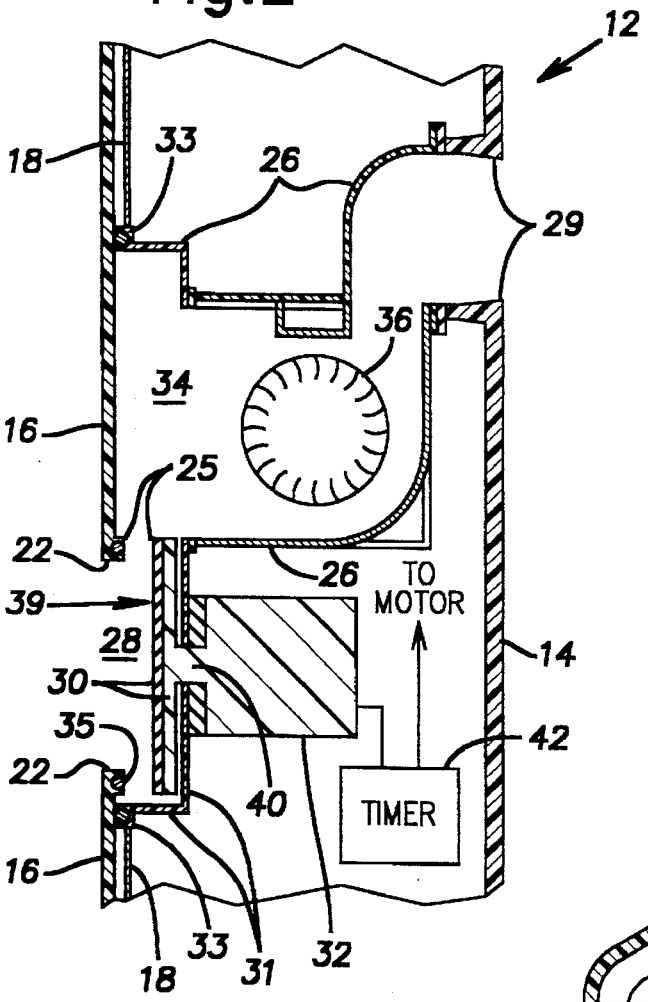
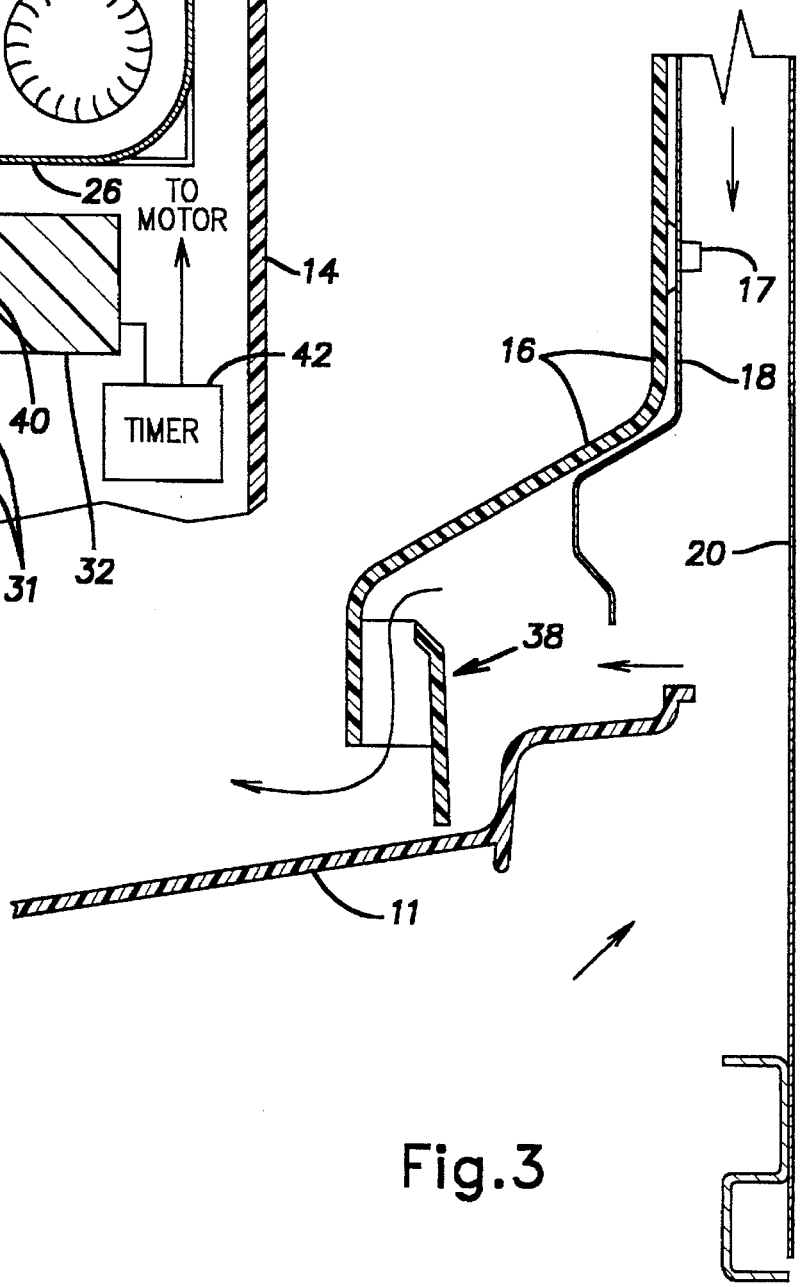
Fig.3

DISHWASHER VENT SYSTEM

This invention relates to a vent system for dishwashers. The invention is particularly suitable to front-loading dishwashers having a door that hinges up to closed position for washing and down to open position for loading and unloading.

BACKGROUND OF THE INVENTION

Various venting arrangements have been provided for allowing dishwashers of the above general type to admit dry air and exhaust moisture-laden air during the drying cycle of the washer so as to add to the efficiency of the drying operation. Examples are seen in several U.S. patents.

U.S. Pat. No. 3,876,469 to Schimke shows a passive venting system with an air inlet at the bottom of the door and an air outlet at the top of the door. A flapper valve controls flow of the air. The door top is considerably enlarged to accommodate the flapper valve and associated control linkage.

U.S. Pat. No. 4,179,821 to Herbst also shows a passive vent. The air inlet is at the top of the door.

U.S. Pat. No. 3,908,681 to Schimke shows a dynamic venting system. Air is drawn in by a fan near the top of the door and exits through an outlet at the bottom of the door. The fan is energized continuously or intermittently during the drying cycle. The fan ducting is always open.

U.S. Pat. Nos. 3,092,122 to Guth and 4,247,158 to Quayle show other venting arrangements using flapper valves. Quayle also employs a fan at the rear of the tub which blows air over heating elements and into the tub.

Other venting configurations using fans are shown in U.S. Pat. Nos. 3,064,662 to Given, 3,130,737 to Jellies, 4,657,036 to Yake, 5,076,306 to Suzuki and 5,355,900 to Sakata.

SUMMARY OF THE INVENTION

The present invention provides a novel venting arrangement for dishwashers of the front-loading type. Venting means is carried in the dishwasher door and is operative to either passively or dynamically draw in dry air during the drying cycle, circulate it through the dishwasher interior so the air will absorb moisture and become saturated, and exhaust the moist or saturated air. The venting means is further operative to passively vent the dishwasher interior when the washer is not in operation, and to seal off moisture, noise and heat from the exterior of the washer during the wash cycle proper.

These operations are accomplished by means contained within the dishwasher door and arranged to operate quietly and unobtrusively even though the door panels are potential sounding boards for any noises generated by the operation of door-mounted valves, actuators or other mechanisms.

The invention accomplishes the venting of drying air in a controlled manner that provides a gradual and quiet transition between open and closed states of a linearly actuated exhaust valve in the exhaust ducting. The valve proper may be a thin, preferably rectangular, molded-plastic, rubber-covered plate mounted within a valve chamber for linear movement, along a path perpendicular to its face, between fully open and fully closed positions. The seating face of the valve is preferably covered with a surface of sealing material such as a layer of rubber or rubber-like sheet which covers the entire seating face or at least its outer seating portions. The valve or plate is moved linearly by the actuator in one or the other direction normal to the plane of the plate to advance and retract the plate in relation to a valve port or wash chamber exhaust port, preferably also rectangular, to thereby open and close the valve by opening and closing the flow connection between the valve port and the valve chamber. The valve port may simply be an opening in the inner liner of the door, and is preferably framed by a sealing lip against which the valve plate seats and seals when the valve is fully closed. A grill insert may be received in the valve port.

The valve chamber exhausts through exhaust ducting and a vent at the front of the door. Such ducting may include a pump chamber with which the valve chamber directly communicates and which contains a cross-flow or paddle wheel type blower extending across the width of the chamber and whose axis is generally parallel to the spaced inner and outer faces of the door. Preferably the valve chamber and pump chamber are of comparable dimension along the width of the door, with the valve chamber opening directly into the pump chamber.

This exhaust valving and ducting arrangement lends itself to containment within the confines of the door thickness, preferably within a control console section extending across the top of the door, while providing valved exhaust ducting of generous cross-section.

The valving and exhaust ducting arrangement further lends itself to inclusion in a system in which dry air is drawn in to the bottom of the warm washing chamber during drying, and moisture laden air is discharged at the top of the chamber, thereby contributing to drying efficiency. This is accomplished simply by combining an inlet for dry air at the door bottom with the above-discussed exhaust ducting and valving arrangement, which is at the top of the door.

BRIEF DESCRIPTION OF THE DRAWINGS

In the drawings.

FIG. 2 is a schematic view on an enlarged scale showing the inner liner or face of the dishwasher door and the metal mid-door or liner of the dishwasher door, such view being taken from the plane of line 2—2 in FIG. 1; FIG. 2 further schematically shows additional elements as they are viewed from the same plane when the console is turned upwardly 90 degrees around its lower edge from the attitude shown in FIG. 1 to its actual attitude in the installed condition.

FIG. 3 is a schematic view on the same scale taken from the plane of line 3—3 in FIG. 1 and also showing certain additional elements not seen in FIG. 1 but which form part of the dishwasher door and the dishwasher tub bottom.

DETAILED DESCRIPTION

Figure 1:
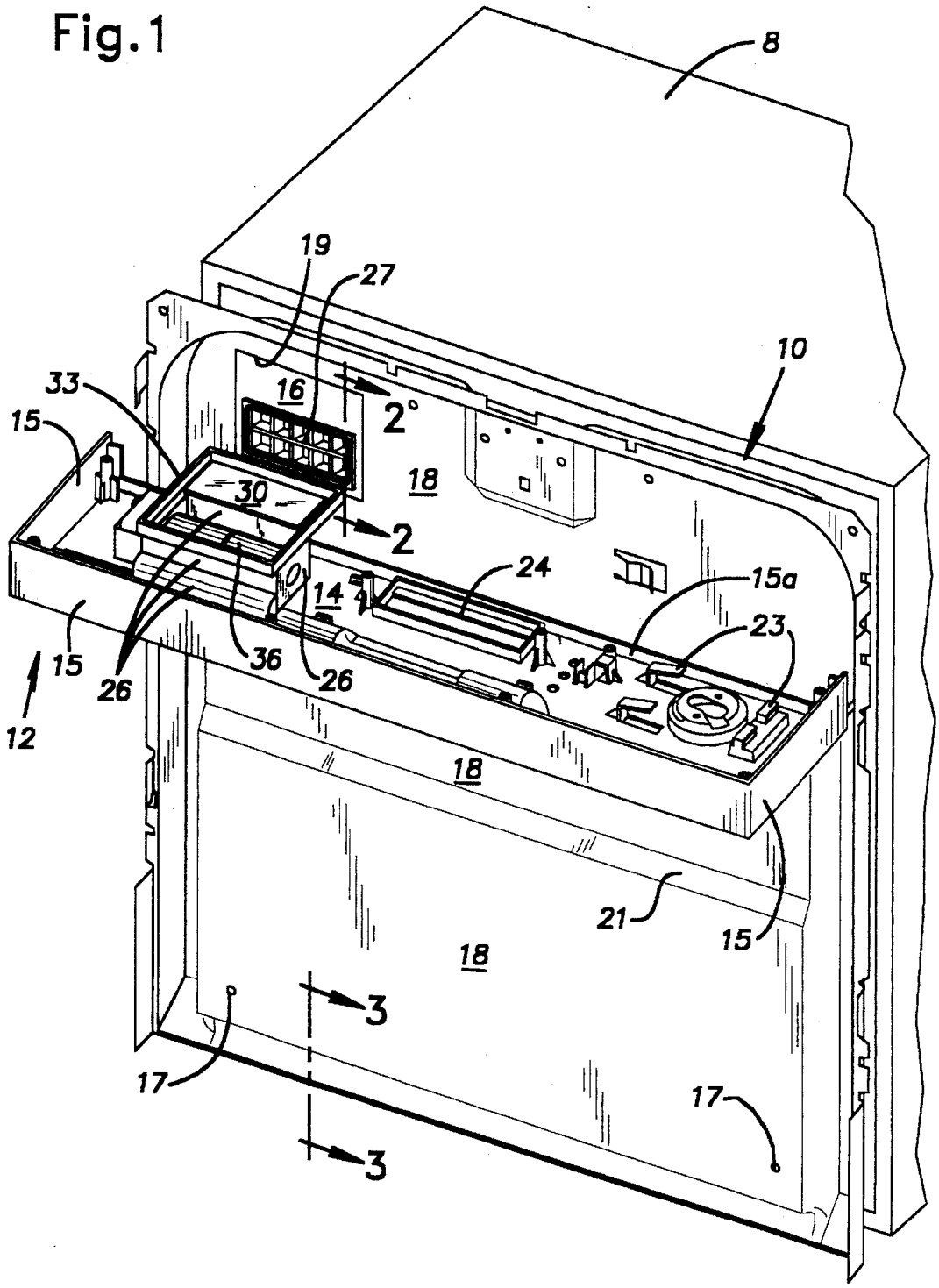
FIG. 1 is an isometric view of part of a dishwasher door, and of an associated molded plastic control console having a front panel to which control elements such as a molded plastic timer housing are mounted, the top and side edges of the front panel being edged with a wide flange to form the top and sides of the console. For purposes of illustration, the console is shown as turned around its lower edge ninety degrees away from other illustrated parts of the dishwasher door, so that the console is viewed from above and behind in the drawing.

Referring to FIG. 1, a partial dishwasher door assembly 10 has mounted thereto at its upper part a molded plastic control console 12 which has a front wall or panel 14. The top and side edges of the panel 14 are edged with a relatively wide flange 15 forming the top and sides of the console. The bottom of the console may comprise a narrow stiffening flange 15*a*, leaving the majority of the console bottom open to portions of the dishwasher door interior that are below it.

The dishwasher door includes a molded plastic inner door face or liner 16. In a well known manner, when the door is closed, the liner forms a front wall of a dishwasher tub 8 and closes off the tub interior, and when the door is fully open, the liner forms a generally horizontal door surface over which dish racks or baskets may be retracted and advanced between washings in order to remove washed dishes and replace them with a new load of dirty dishes. The tub may comprise a tub bottom 11 (FIG. 3) having a central drain sump portion (not shown) and side, back and top walls (not shown) which, together with the door, form a wash chamber when the door is closed. The tub construction may be generally as shown in U.S. Pat. No. 4,940,298 to common assignee, the disclosure of which is incorporated herein by reference.

In the particular device illustrated, a metal mid-door or panel 18 is spaced slightly in front of the inner door liner 16 by shouldered spacers 17 (FIGS. 1, 3) which frictionally engage registering openings or holes in the panel 18. The panel 18 may be formed with a shoulder 21 so that the panel is closer to the front of the door at the lower portions of the door than it is at the upper portions of the door. The inner door face or liner 16 may have a similar shoulder (no seen) so that the two elements are spaced the same distance apart throughout most of their areas, both at the top and bottom parts of the door.

The front of the door may include a metal liner 20 which is a front or outer panel forming part of the face of the door and extending from the door bottom to the bottom of the console 12. The top of panel 20 may be in the same plane as the front wall 14 of the installed console, the two elements simply forming a straight joint or seam at their abutting edges.

Since the elements 16 and 18 are closer to the plane of the front of the door at bottom portions of the door than at top portions of the door, the thickness of the door, across the majority of its width, is greater at its top portions than at its bottom portions, as reflected in the fact that the elements 16 and 18, as seen in FIG. 2, are further from the console front wall 14 than these elements, as seen in FIG. 3, are from the front panel 20.

The control console may contain various elements related to control and manipulation of the dishwasher, for example, molded brackets 23 for mounting a timer housing (not shown) and a molded framed handle opening 24 for allowing the door to be grasped from the exterior or front when it is to be opened. This handle opening may also function as an air intake to admit ambient air to the interior of the console 12 from whence it may be drawn into the washer interior as described below. Alternatively, a separate intake opening (not shown) may be provided in the front panel 20 or elsewhere on the front of the door.

According to the present invention, an exhaust system is provided in association with the dishwasher door. This system includes a valve port or wash chamber exhaust port 22 (FIG. 2) opening through the inner face of the door from the interior of the wash chamber into a vapor chamber or valve chamber 28 within the door. This wash chamber exhaust port may be provided with a suitable molded plastic grille insert 27, (shown in FIG. 1 but not in FIG. 2).

As seen in FIG. 2, the valve chamber 28 may be relatively shallow as compared with the overall thickness of the console 12. Associated with the valve chamber is a valve member 30 in the form of a plate which is mounted for linear movement normal to its plane and to the plane of the dishwasher door, and is closable against the exhaust port 22. The exhaust port 22 is preferably provided with an integral rim which receives a rubber sealing lip or gasket 35, as shown, and the plate-shaped valve member 30 is provided, as shown, with a face sheet of rubber 39 or rubber-like material which closes against such sealing lip.

As best seen in FIG. 2, on the side of the valve chamber 28 closest to the front of the dishwasher, the valve member 30 may have a central stem 40 which extends through a wall 31 of the valve chamber and is associated with a suitable linear actuator 32. It is preferred that such actuator 32 be one of the type known as wax actuators which have the characteristic of imparting relatively gradual axial movement to an element such as the illustrated valve stem. Eltek of Italy makes suitable actuators. The actuator is concentrically aligned with the valve 30. The imparted movement is back and forth in opposed axial directions when the actuator is respectively electrically heated above ambient temperature or allowed to cool back down to ambient temperature. The valve member is preferably normally in closed position, so that it gently and quietly opens as the actuator is heated and closes as the actuator is allowed to cool. In a known manner, the actuator uses heated expanding wax to produce a linear actuation stroke in the opening direction. As the wax is allowed to cool, an internal spring (not shown) returns the actuator to its original position to thereby close the valve. As will be understood from the drawings and the above description, the path on which the valve member or plate 30 is driven back and forth by the actuator is not only perpendicular to the plate 30 and to the dishwasher door, such path is also located entirely within the door.

An exhaust port 25 of the valve chamber 28 may simply comprise the uppermost side of the valve chamber. As shown, such upper side may be completely open to adjacent suitable molded plastic ducting 26, such ducting being provided to receive moist exhaust air from the valve chamber 28 and guide the exhaust air from rear to front through the thickness of the door. Such ducting empties through a duct exhaust port 29 formed in the console front wall 14.

Such ducting preferably includes a blower chamber 34 and a cross-flow type blower 36 extending across the width of the blower chamber and designed to pull in air from the valve chamber exhaust port 25 and propel the air to the duct exhaust port 29. Cross-flow blowers, manufactured by Fergas of Sweden have been found suitable for this purpose. The blower functions much like a riverboat paddle wheel. The cross-flow blower is quiet and of relatively small size. The blower uses a small c-frame induction motor which can be stalled continuously without overheating.

The walls 31 of the valve chamber 30 and the walls of the exhaust ducting 26 may be combined in a molded unit having a front rim 33 adapted to mount a sealing lip as shown in FIG. 2, the rim 33 fitting within a window or cut-out 19 (FIG. 1) formed in the metal mid-door 18.

The exhaust port 29 is located above and well to one side of the framed handle opening 24, so that if the latter is used as a ambient air intake there will be little cross flow between such intake and the exhaust from port 25 externally of the door. The inner liner 16 of the door is preferably shaped as seen in FIG. 3 so a to overlie the front lip of the tub bottom 11 and provide a baffle arrangement generally indicated at 38.

During-ash cycles, the valve 30 is in its normally closed position. When a wash cycle is completed, the wash chamber is full of moist warm air. When the valve 30 is then opened, the moist warm air in the wash chamber tends to rise and passes through the valve chamber 28 and out through the duct exhaust 29 into the kitchen or other room in which the washer is located. As this exhaust flow occurs, dry replacement air is drawn from the kitchen or other room into the wash chamber along the paths indicated by arrows in FIG. 3. Some of the dry air is admitted at the handle frame 24 or elsewhere where an air intake is provided, preferably near the top of the door, and passes downwardly between the metal mid-door 18 and outer door panel 20. Other dry air is admitted at the bottom of the dishwasher door, flowing upwardly past the front lip of the tub bottom 11. Downflowing and upflowing streams of dry air join to flow together toward and through the baffle arrangement 38 and into the wash chamber interior. As the dry air enters the wash chamber it absorbs heat and moisture and tends to become saturated. This warmed air then tends to rise and passes out the exhaust 29 and into the kitchen or other room, drawing in still more dry air. This drying cycle continues as additional heat and moisture continue to be extracted from the wash chamber, and may be sustained by continuing to heat the wash chamber so as to continuously supply new heat energy for incoming dry air. If no additional heat is provided, or when it is discontinued, the drying cycle tapers off until the temperature of the air in the wash chamber drops to a level insufficient to sustain significant drying circulation.

The cycle as above described applies even without the provision of an exhaust fan such as the blower 36. Provision of the blower considerably augments airflow and improves drying action.

A timer 42 that is supported by the brackets 23 provides a control cycle whereby the valve 30 is opened at the conclusion of the wash cycle and is closed preferably about 30 minutes later. If a blower such as the blower 36 is provided, the timer also energizes the blower when the valve 30 is opened, and de-energizes it when the valve is closed. When the venting function, with or without the blower 36, is switched off, the dishwasher is still allowed to breath in and out through the baffle arrangement 38.

It should be evident that this disclosure is by way of example and that various changes may be made by adding, modifying or eliminating details without departing from the fair scope of the invention or the teaching contained in this disclosure. For example, venting inlets and outlets may be located at different locations than those described, or the described separately defined control console at the top of the door may be dispensed with. The invention is therefore not limited to particular details of the disclosure except to the extent that the following claims are necessarily so limited.

What is claimed is:

1. In a dishwasher having a box-like tub, said tub having an open front, a door for said open front of said tub, said tub and door comprising therebetween a wash chamber for receiving articles therein, means for washing the articles in the chamber, and means including a timer for sequentially operating, the washing means through washing cycles and a drying cycle, venting means for the chamber, said venting means including an exhaust means at the top of and within the door, said exhaust means including a valve port formed in an inner face of the door and opening from an interior of said wash chamber to a valve chamber formed within said door, a valve member within the door, said valve member being in the form of a plate movable through said valve chamber and closable against said port, a linear actuator for moving said plate in one or the other direction to advance and retract the plate within said valve chamber to respectively close and open said valve port, and duct means leading from said valve chamber to a front exterior of said door.

2. A device as in claim 1, said plate being mounted to be driven by said actuator on a path within said door and perpendicular to its own plane and the plane of said door.

3. A device as in claim 2, said linear actuator also being mounted within said door at the same level as and in concentric alignment with said plate.

4. A device as in claim 1, said exhaust port receiving a grille insert and being framed by a sealing lip of rubber or rubber-like material, said plate having a face closable over said grille insert and against said sealing lip to close said port.

5. A device as in claim 4, said plate face comprising, at least at portions adjacent the periphery of said plate, a layer of rubber or rubber-like material positioned to contact said sealing lip when said valve is closed.

6. A device as defined in claim 1, said last named duct means comprising a blower chamber downstream of said valve chamber and within said door, a cross-flow type blower extending across the width of said blower chamber, the axis of said blower being generally parallel to the spaced inner and outer faces of the washer door.

7. In a dishwasher having a box-like tub, said tub having a bottom wall, a top wall, two side walls, a back wall and an open front, a door for said open front of said tub, said tub and door comprising therebetween a wash chamber for receiving articles therein, means for washing the articles in the chamber, and means including a timer for sequentially operating the washing means through washing cycles and a drying cycle, venting means for the chamber, said venting means including an exhaust means at the top of the door and within the thickness thereof, said exhaust means including an exhaust port formed in the inner face of the door and opening from the interior of said wash chamber to a valve chamber formed within said thickness of said washer door, a valve member in the form of a plate closable against said port, a linear actuator for moving said plate normally to its plane in one or the other direction to retract and advance said plate within said valve chamber to respectively open and close said valve port, and exhaust ducting leading from said valve chamber to the front exterior of said door.

8. A device as defined in claim 7, said exhaust ducting comprising a blower chamber downstream of said valve chamber and within said door, a cross-flow type blower extending across the width of said blower chamber, the axis of said blower being generally parallel to the spaced inner and outer faces of the washer door.

9. A device as defined in claim 8, said valve chamber and blower chamber being of comparable dimension along the width of the door.

10. A device as defined in claim 9, said valve chamber opening directly into said blower chamber.

11. A device as defined in claim 10, the top portion of said door comprising a control console, said exhaust means being located within said control console.

12. A device as defined in claim 9, said linear actuator comprising a wax actuator.

13. A device as defined in claim 9, said timer means being adapted to energize said actuator near the beginning of said drying cycle to gradually move said valve plate to a fully open position and to then, after a predetermined interval, de-energize said wax actuator to gradually move said valve plate to fully closed position.

14. A device as defined in claim 10, said timer means being adapted to energize said blower and said actuator near the beginning of said drying cycle to turn on said blower and gradually move said valve plate to fully open position and to then, after a predetermined interval, de-energize said blower and actuator to turn off said blower and gradually move said valve plate to a fully closed position.

15. In a dishwasher having a box-like tub, said tub having a bottom wall, a top wall, two side walls, a back wall and an open front, a door for said open front of said tub, said door having a thickness defined by spaced outer and inner faces, said tub and door comprising therebetween a wash chamber having rack means for receiving articles therein, means for washing the articles in the chamber, and means including a timer for sequentially operating the washing means through washing cycles and a drying cycle, venting means for the chamber, said venting means including baffled passage means formed in the door bottom for permanently venting the wash chamber to the washer exterior at the door bottom, said venting means further including exhaust means at the top of the door and within the thickness thereof, said exhaust means including an exhaust port formed in the inner face of the door and opening from the interior of said wash chamber to a valve chamber formed within the thickness of said washer door, a valve member in the form of plate closable against said exhaust port, a valve actuator to advance and retract said plate within said valve chamber to respectively close off and open said valve port, and duct means leading from said valve chamber to the front exterior of said door.

16. A device as in claim 15, said duct means comprising a blower chamber downstream of said valve chamber and within the thickness of said door, and a cross-flow type blower extending across the width of said blower chamber, the axis of said blower being generally parallel to the spaced inner and outer faces of the washer door.

17. A device as in claim 15, said atuator being of the wax actuator type.

18. A device as in claim 16, said actuator being of the wax actuator type.

19. A device as defined in claim 17, said timer means being adapted to energize said wax actuator near the beginning of said drying cycle to gradually move said valve plate to fully open position and to then, after a predetermined interval, de-energize said wax actuator to gradually move said valve plate to a fully closed position, said baffled passage means remaining open at all times whereby said wash chamber continues to be open to ambient air after said valve plate reaches said fully closed position.

20. A device as defined in claim 18, said timer means being adapted to energize said blower and said wax actuator near the beginning of said drying cycle to turn on said blower and gradually move said valve plate to fully open position and to then, after a predetermined interval, de-energize said blower and wax actuator to turn off said blower and gradually move said valve plate to a fully closed position, said baffled passage means remaining open at all times whereby said wash chamber continues to be open to ambient air after said valve plate reaches said fully closed position.

* * * * *